US007900747B2

(12) United States Patent
Guralnik

(10) Patent No.: US 7,900,747 B2
(45) Date of Patent: Mar. 8, 2011

(54) BALLOON LANDING PAD

(76) Inventor: Mordechai Issac Guralnik, Teaneck, NJ (US)

( * ) Notice: Subject to any disclaimer, the term of this patent is extended or adjusted under 35 U.S.C. 154(b) by 25 days.

(21) Appl. No.: 11/644,145

(22) Filed: Dec. 22, 2006

(65) Prior Publication Data

US 2007/0193830 A1 Aug. 23, 2007

Related U.S. Application Data

(60) Provisional application No. 60/753,951, filed on Dec. 23, 2005.

(51) Int. Cl.
*A62B 1/22* (2006.01)

(52) U.S. Cl. ..... 182/137; 182/138

(58) Field of Classification Search ..... 182/137, 182/138; 482/15; 5/350
See application file for complete search history.

(56) References Cited

U.S. PATENT DOCUMENTS

| | | | | | |
|---|---|---|---|---|---|
| 396,242 | A | | 1/1889 | Simon | |
| 715,560 | A | | 12/1902 | Dedrick | |
| 933,671 | A | * | 9/1909 | Schonboe | 182/137 |
| 958,383 | A | * | 5/1910 | Fischer | 182/137 |
| 2,906,366 | A | | 9/1959 | Mapes | |
| 3,460,828 | A | * | 8/1969 | Curlee | 472/26 |
| 3,513,491 | A | * | 5/1970 | Gordon | 5/420 |
| 3,840,922 | A | * | 10/1974 | Morrison et al. | 482/15 |
| 3,883,913 | A | * | 5/1975 | Givens | 441/37 |
| 3,972,526 | A | * | 8/1976 | Cox, Jr. | 446/28 |
| 4,005,236 | A | * | 1/1977 | Graebe | 428/72 |
| 4,068,739 | A | * | 1/1978 | Gordon et al. | 182/139 |
| 4,148,521 | A | * | 4/1979 | Van Hook | 297/118 |
| 4,168,061 | A | * | 9/1979 | Gordon | 482/8 |
| 4,215,857 | A | * | 8/1980 | Gordon | 482/15 |
| 4,629,182 | A | * | 12/1986 | Rader et al. | 482/35 |
| 4,698,864 | A | * | 10/1987 | Graebe | 5/654 |
| 4,929,181 | A | * | 5/1990 | Undlin | 434/236 |
| 5,150,767 | A | | 9/1992 | Miller | |
| D347,248 | S | * | 5/1994 | Franzman | D21/424 |
| 5,596,781 | A | * | 1/1997 | Graebe | 5/710 |
| 5,690,584 | A | * | 11/1997 | Strawcutter et al. | 482/35 |
| 5,772,535 | A | * | 6/1998 | Murphy | 473/415 |
| 5,813,946 | A | * | 9/1998 | Lin et al. | 482/27 |
| 6,353,953 | B1 | * | 3/2002 | Tanaka et al. | 5/723 |
| 6,546,580 | B2 | * | 4/2003 | Shimada | 5/710 |
| 6,715,174 | B2 | * | 4/2004 | Tsai | 5/709 |
| 6,764,408 | B1 | * | 7/2004 | Coleman | 472/134 |
| 7,244,216 | B2 | * | 7/2007 | Rastegar | 482/15 |
| 2005/0194058 | A1 | * | 9/2005 | Hanchett | 141/7 |
| 2007/0123141 | A1 | * | 5/2007 | Berkey et al. | 446/220 |

FOREIGN PATENT DOCUMENTS

| | | |
|---|---|---|
| EP | 0983776 | 12/2002 |
| FR | 2277600 | 2/1976 |

OTHER PUBLICATIONS

JP404164462A Jun. 10, 1992 Yamada Sadayuki; Lifesaving Tool With Rubber Rope Nettings in Stages at Certain Spacings—English Abstract.

* cited by examiner

*Primary Examiner* — Katherine W Mitchell
*Assistant Examiner* — Candace L Bradford
(74) *Attorney, Agent, or Firm* — Irving M. Fishman

(57) ABSTRACT

A balloon landing pad having multiple layers, each layer having its own cushioning properties, wherein the cushioning is provided by the materials of the pad in conjunction with a positive gas pressure within the pad, while offering a gradient of resistance as layers are penetrated so as to prevent a person or object from hitting the ground after falling from a considerable height thereon.

35 Claims, 21 Drawing Sheets top view of 3x3 section unit with straight-line-slip-through-slot openings top view of 3x3 section unit with diagonal-line-slip-through-slot openings top view of 3x3 section unit with circular-slip-through-slot openings

BALLOON LANDING PAD

CROSS-REFERENCE TO RELATED APPLICATIONS

This application claims the benefit of U.S. 60/753,951, filed Dec. 23, 2005.

STATEMENT REGARDING FEDERALLY SPONSORED RESEARCH OR DEVELOPMENT

Not Applicable

FIELD OF THE INVENTION

The present invention relates rescue equipment, especially with respect to escaping from considerable heights. The invention relates more particularly to cushioning devices for falling people or objects.

BACKGROUND OF THE INVENTION

Almost all cities today, and many small towns, contain many buildings that are over 6 stories tall. While major advances have been made in making taller buildings resistant to natural and man-made disasters such as fire, earthquake, and terror attacks, these buildings are simply not invincible. Rescue equipment from the ground, such as ladders, is for the most part limited to 6 stories and under. For higher elevations, rescue from the air is possible, but it is slow and tedious, with only a few persons being rescued per trip, generally not more than three. In addition, modern high rise office buildings have considerable numbers of people on each floor so that if normal egress though stairwells is blocked, rescue efforts of those in higher stories are effectively eliminated. Currently used air cushions are known in automobiles (air bags) which are small and individual single use devices. Other air cushions are known in the entertainment industry for "moon walk" entertainment, which is nothing more than an air filled container upon which one or more persons walk or jump on, but not fall onto from significant heights. Still other air cushion devices are used in the film industry to cushion stunt people from falls typically not greater than a few stories (generally less than 3), and these devices are used for one person at a time. Still other inflatable devices include life rafts and life jackets, which are rather small and do not have persons falling or jumping onto them from considerable heights. While filling time for these devices is an economic variable, there is either no other concern over the time it takes to inflate the device or the device in question is quite small so that inflation time is rapid.

Thus, there is a substantial unmet need in having a rescue device for use in situations where rescue is required from stories beyond which conventional ladders can reach, that can effect rescue of multiple people in a short period of time, that is reasonably economical for institution by municipalities, and that can be quickly deployed and reused within relatively short periods of time.

OBJECTS OF THE INVENTION

It is therefore an object of the invention to provide a balloon landing pad for the rescue of persons falling or jumping out of tall buildings or other elevated structures.

It is a further object of the invention to provide a balloon landing pad that can accommodate multiple persons jumping or falling onto it at the same or substantially the same time.

It is another object of the invention to provide a balloon landing pad that can quickly be reinstated to a suitable cushioning state for rescue of an additional person after cushioning the fall of another person.

Still another object of the invention is to provide a balloon landing pad that can be used in the forgoing objects that can be promptly set in place by rescue workers and brought to a suitable cushioning state to accommodate persons falling or jumping thereon from substantial heights.

Yet another object of the invention is to provide a balloon landing pad that can be stored on site in multiple locations with a minimum of storage space.

An even further object of the invention is to provide a balloon landing pad that can be within the economic wherewithal of municipalities or of large building landlords.

Another object of the invention is the provision of a balloon landing pad to provide protection for persons passing by construction and/or demolition sites from debris that might fall therefrom.

Even further objects of the invention will be apparent to those of ordinary skill in the art.

BRIEF SUMMARY OF THE INVENTION

These and other objects of the invention are surprisingly achieved by a balloon landing pad having multiple stories, each story having its own cushioning properties, wherein the cushioning is provided by the materials of the pad in conjunction with a positive gas pressure within the pad while offering a gradient of resistance as stories are penetrated so as to prevent a person or object from hitting the ground after falling from a considerable height thereon. The device is of sufficient size to substantially avoid a person falling (or jumping) from missing the device in an effort to escape from a point of considerable height due to a misjudgment in the horizontal distance traveled in the course of jumping or falling.

BRIEF DESCRIPTION OF THE DRAWINGS

FIG. 13-*b* is a vertical cross-section of a device of the present invention showing an alternate evacuation embodiment.

FIG. 14-*b* is the same embodiment as FIG. 14-1 but showing the opening in an open position due to the contact and passage therethrough of a person falling thereon.

FIG. 14-*c* depicts a cross section of the top surface of FIG. 14-*a* showing the arrangement of the overlapping fabric of the opening in a straight cut parallel opening design.

FIG. 14-*d* is a cross section of the upper surface of FIG. 14-*a* showing the opening in the open position as in FIG. 14-*b*.

DETAILED DESCRIPTION OF THE INVENTION

Figure 1:
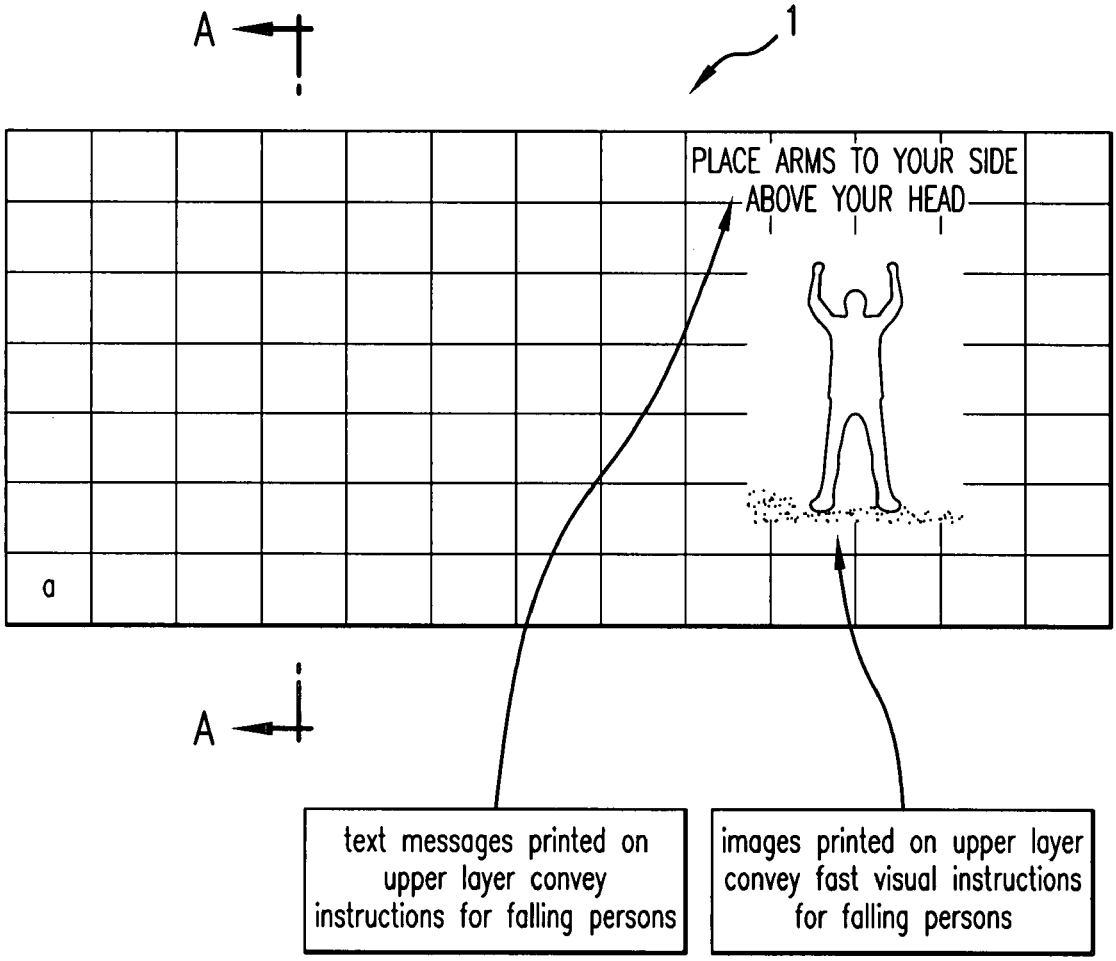
FIG. 1 depicts a top view of a representation of a typical device of the present invention having instructions printed thereon.
Figure 2:
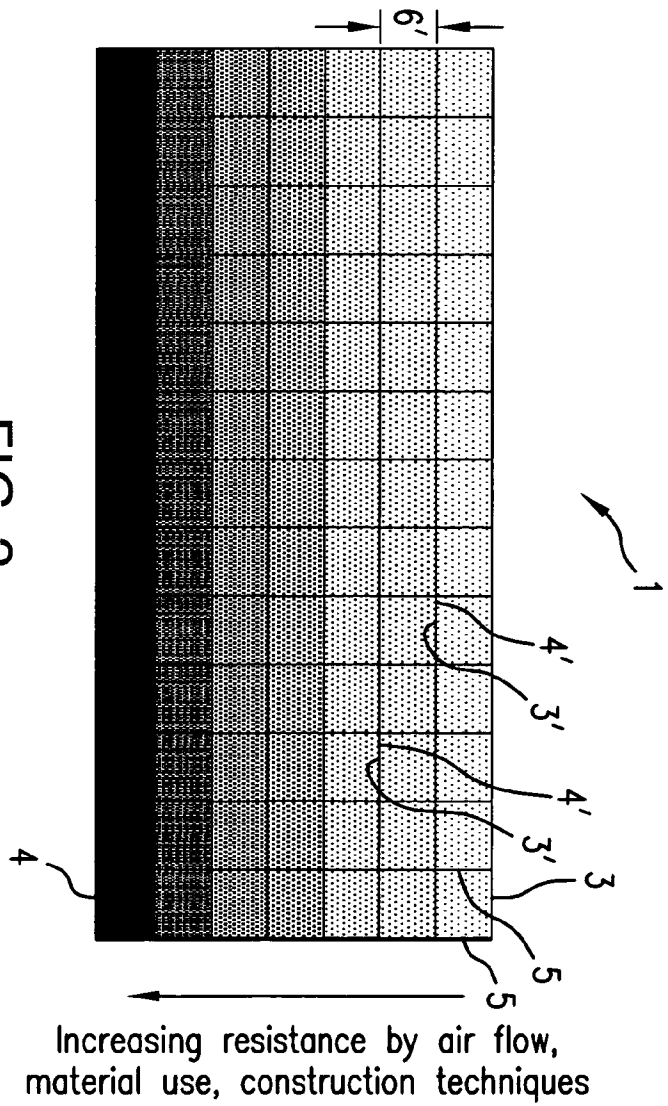
FIG. 2 is a vertical cross section of a representation of a device of the present invention along line A-A of FIG. 1.
Figure 3:
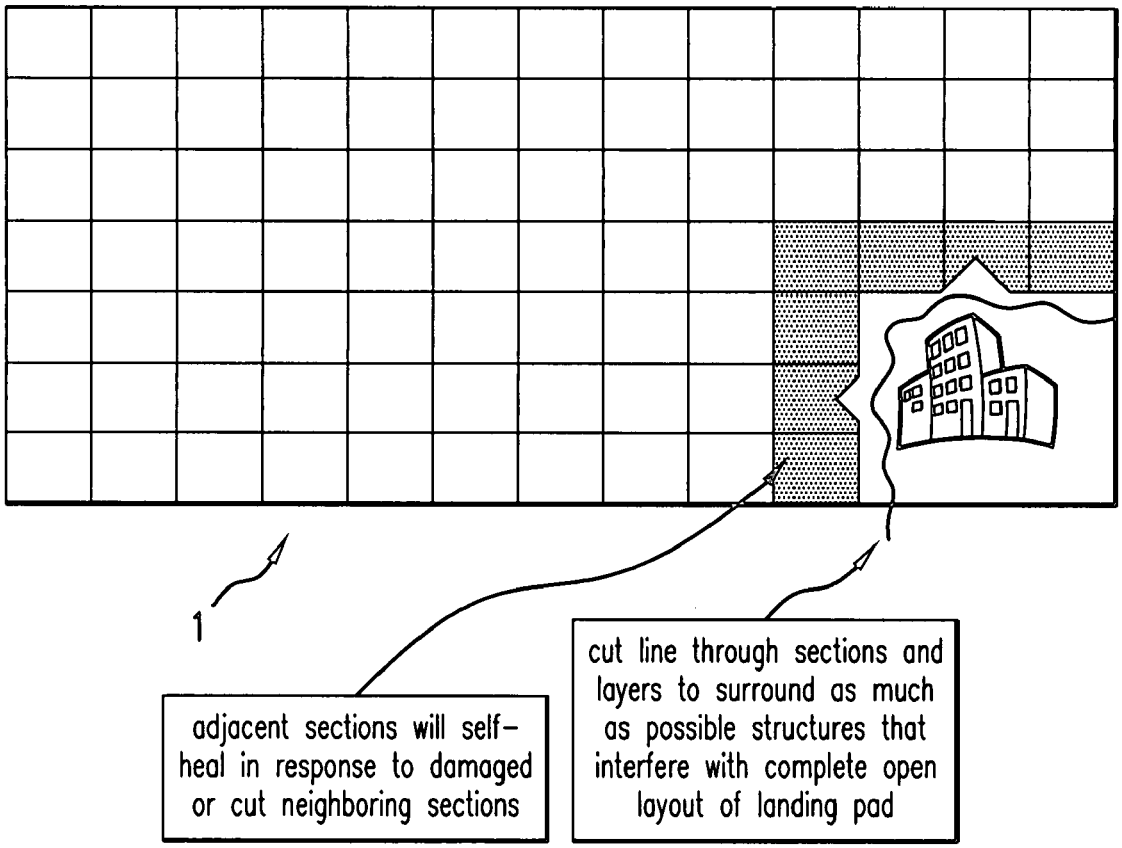
FIG. 3 is a top view of a representation of a device of the present invention having a removed to better deploy the device.
Figure 4:
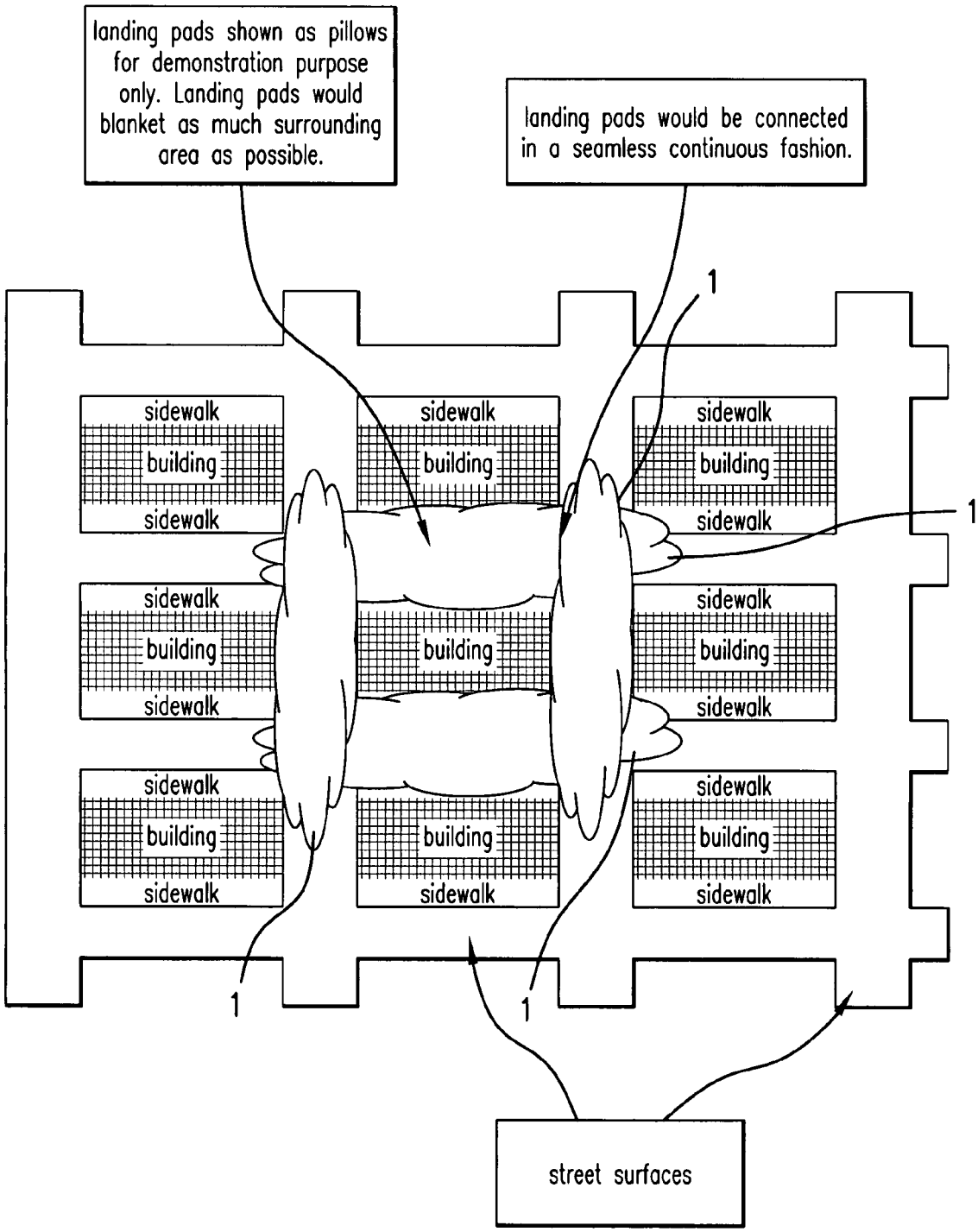
FIG. 4 is a representative view of deployment of several devices of the present invention so as to surround a particular building.
Figure 5:
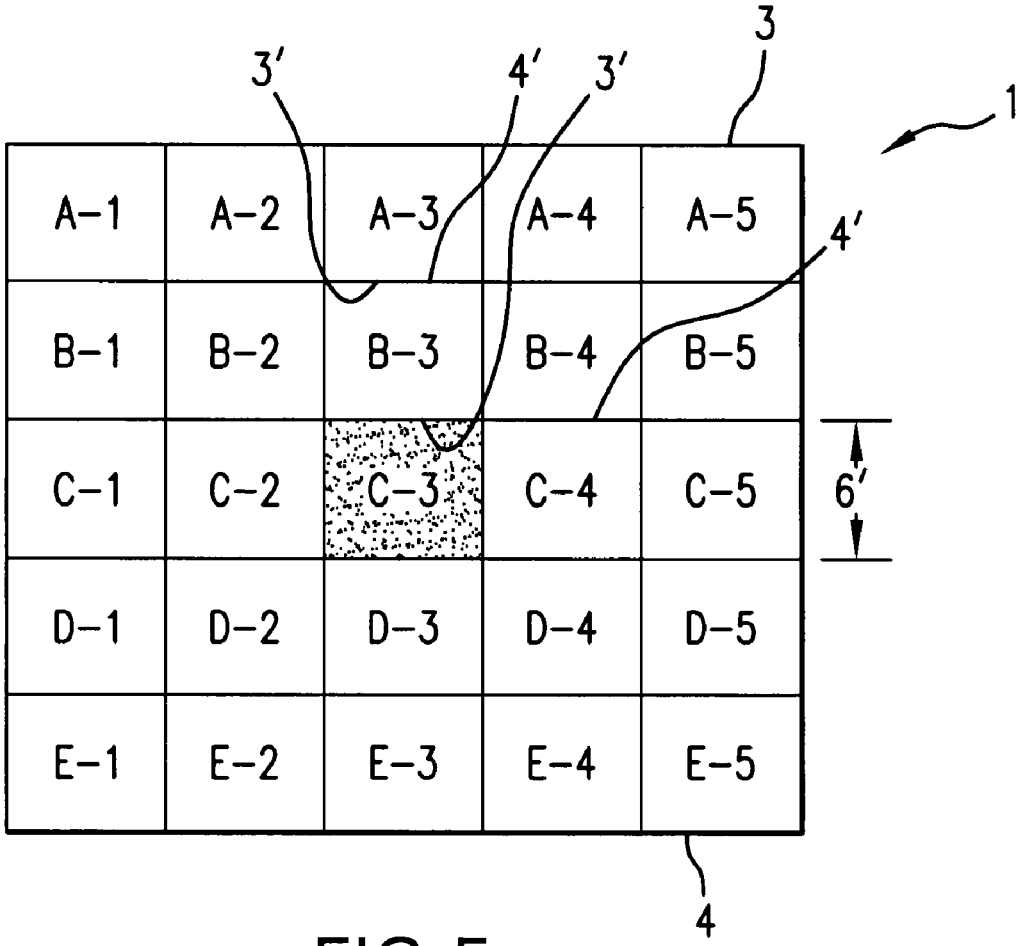
FIG. 5 is a top view of a device of the invention having 25 subsections.
Figure 6:
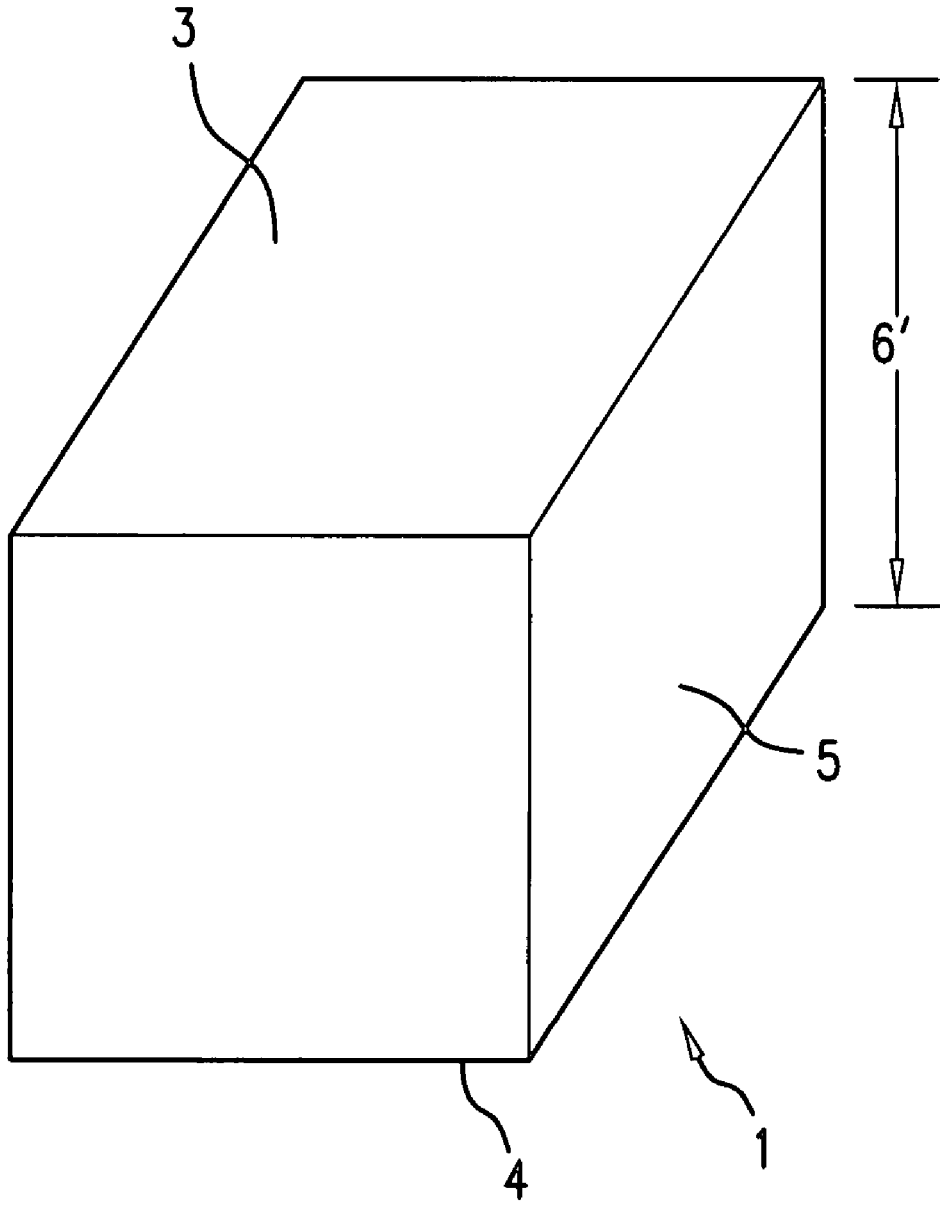
FIG. 6 is a perspective view of a single unit of the invention.

The present invention is directed to a landing pad to cushion the fall of persons, animals, and/or objects from substantial heights, and are especially directed to use in rescue efforts of those trapped in upper stories of buildings, which upper stories are not readily accessible from existing ground based rescue equipment such as ladders and cherry pickers, usually because such upper stories are too high off the ground for those devices to reach. The need for other means to rescue persons from higher stories of tall buildings was made abundantly clear in the destruction of the World Trade Center in New York in 2001. The present invention addresses that need.

In summary, the invention is a landing pad that is designed to cushion the fall of people and animals as well as objects falling from substantial heights, well in excess of those that are reachable from existing external extrication means such as ladders from the ground. Basically, the device allows one trapped on an elevated story to jump out of the building and safely land on the device, the device absorbing the impact in a graded and increasingly resistant manner so that the person or animal so jumping onto it can safely reach the ground without significant injury that would otherwise just not be possible. While some bruising and possible fractures might still result simply because of the individual's health status, etc. life threatening injuries due to falling or jumping from such heights will be substantially, if not totally eliminated.

With reference to the Figures, the landing pad (1) is an inflatable device that generally has multiple stories (2) with increasing resistance to penetration as one permeates from the top (3) to the bottom (4), so that the impact is gradually cushioned and the energy absorbed and dissipated in a gradual manner. The devices of the invention generally have a top (3), a bottom (4), and sidewalls (5) attaching the top (3) to the bottom (4) to define an interior (6). The interior may be a single story, but usually is multiple stories, and generally is 3 or more, preferably 5 or more, more preferably 7 or more, still more preferably 9 or more stories. Each story (once inflated) has an interior open vertical space distance (6') between its story top (3') and its story bottom (4') of not less than about 5 feet, preferably not less than about 6 feet, more preferably not less than about 8 feet, still more preferably not less than about 10 feet, yet more preferably not less than about 15 feet, most preferably not less than about 20 feet. In addition, each story's interior open vertical space distance (6') is not more than about 30 feet, preferably not more than about 25 feet, more preferably not more than about 20 feet. In highly preferred embodiments each story independently contains an interior open vertical space distance (6') in the range of a lower end to an upper end where the lower end may be about 9 feet, about 10 feet, about 11 feet, about 12 feet, about 13 feet, about 14 feet, about 15 feet, about 16 feet, about 17 feet, about 18 feet, about 19 feet, about 20, feet, about 21 feet, about 22, feet, about 23 feet, about 24 feet, or about 25 feet and the upper end is greater than the lower end and is about 25 feet, about 24 feet, about 23 feet, about 22 feet, about 21 feet, about 20 feet, about 19 feet, about 18 feet, about 17 feet, about 16 feet, about 15 feet, about 14 feet, about 13 feet, about 12 feet, about 11 feet or about 10 feet. Most preferably all of the subunits in a particular story have about the same interior open vertical space distance (6'). This distance allows for movement of the person falling into the device as well as rescue personnel to readily move within the story in an effort to rapidly remove rescuees from the device. For the purposes of this paragraph, the dimensions given are fixed based on the side wall distance that connects two adjacent stories. Spacing between stories will vary at other points due to the flexible nature of the device, bowing inward or outward depending upon the gas pressure maintained and whether an object is in the process of falling onto or through the device.

In general, the invention device has a total vertical height of at least about 20 feet, preferably at least about 30 feet, more preferably at least about 40 feet, still more preferably at least about 50 feet, even more preferably at least about 50 feet, yet more preferably at least about 60 feet, still more preferably at least about 70 feet, yet more preferably at least about 80 feet, highly preferably at least about 90 feet, and most highly preferably at least about 100 feet. Obviously, smaller total vertical height devices are suitable for use in connection with shorter falling distances, and those of ordinary skill in the art will readily be able to choose between various device vertical height sizes for use in connection with rescues from variously sized buildings or other structures.

Figure 13A:
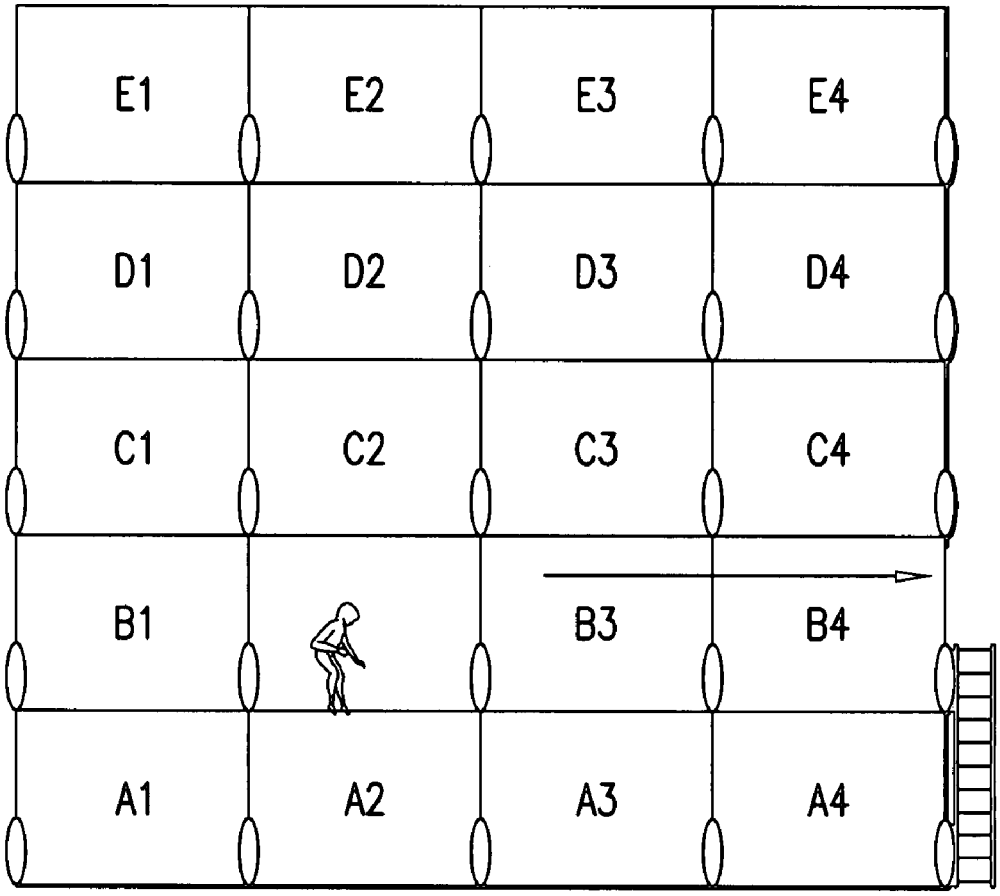
FIG. 13-*a* is a vertical cross section of an embodiment of the invention showing an escape means for a person who has ceased falling through the invention device.
Figure 13B:
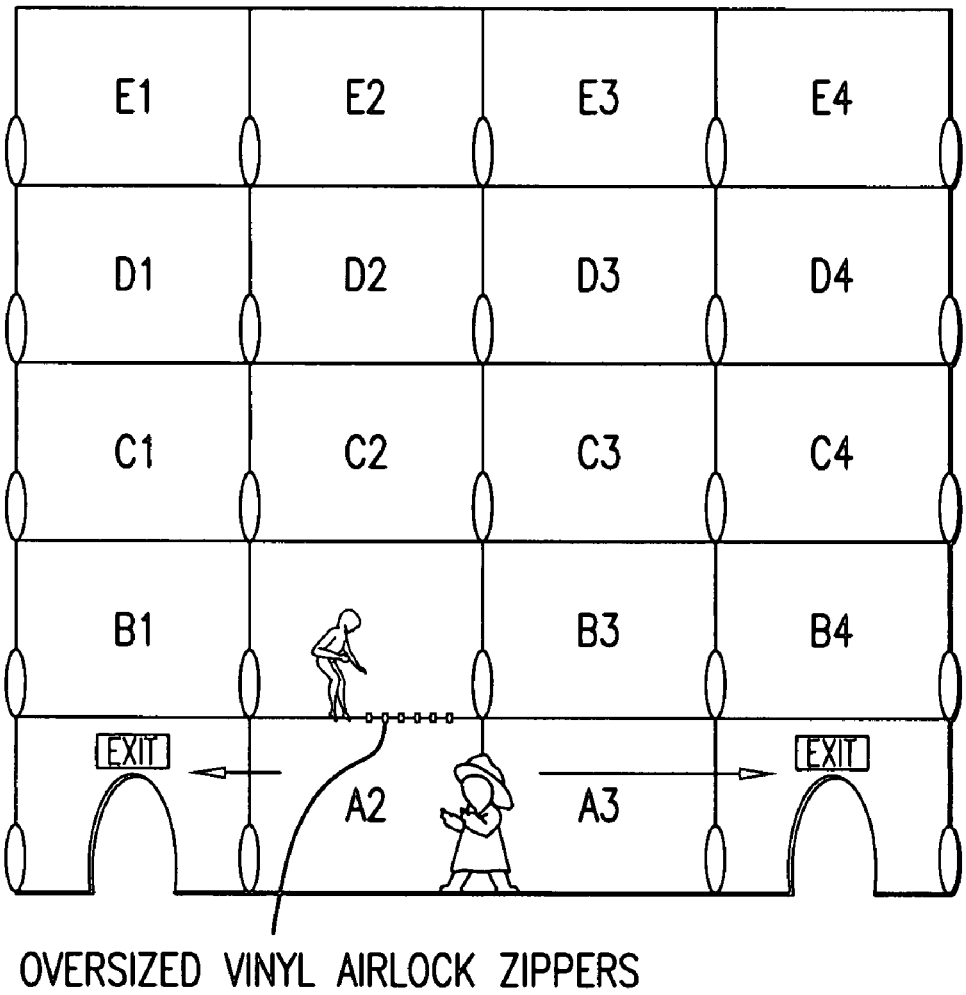
Figure 14A:
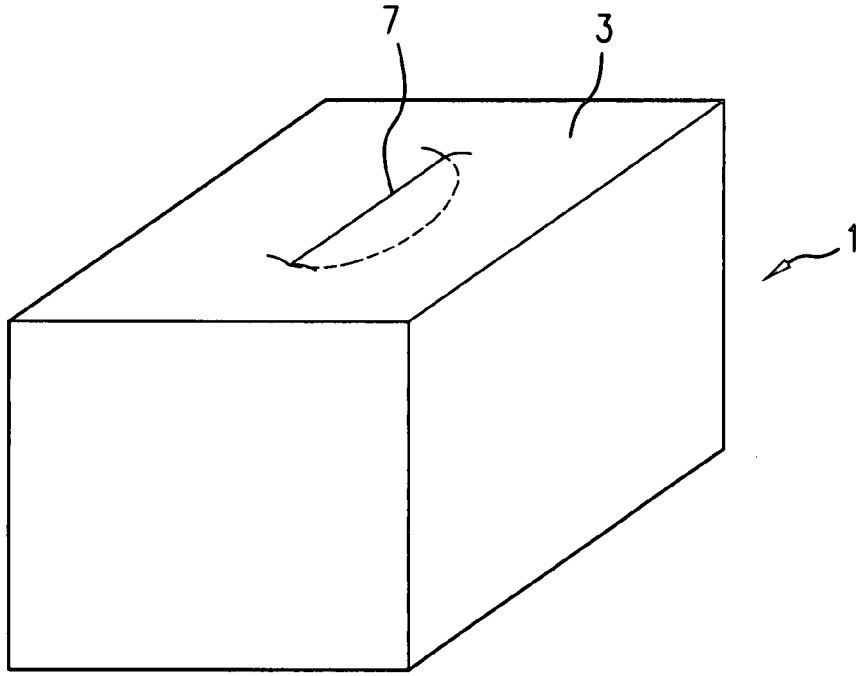
FIG. 14-*a* is a perspective view of a single unit of the invention showing an overlapping flap opening in a closed position.
Figure 14B:
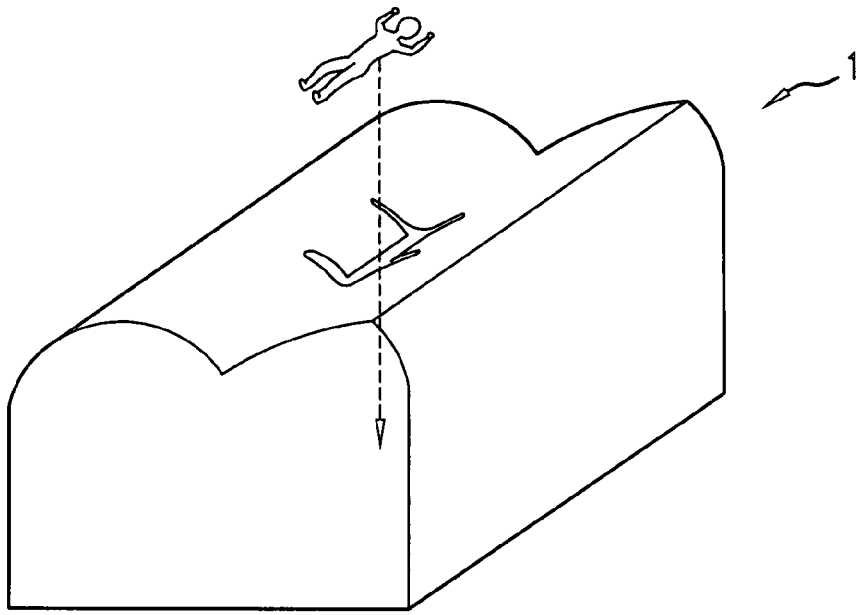
Figure 14C:
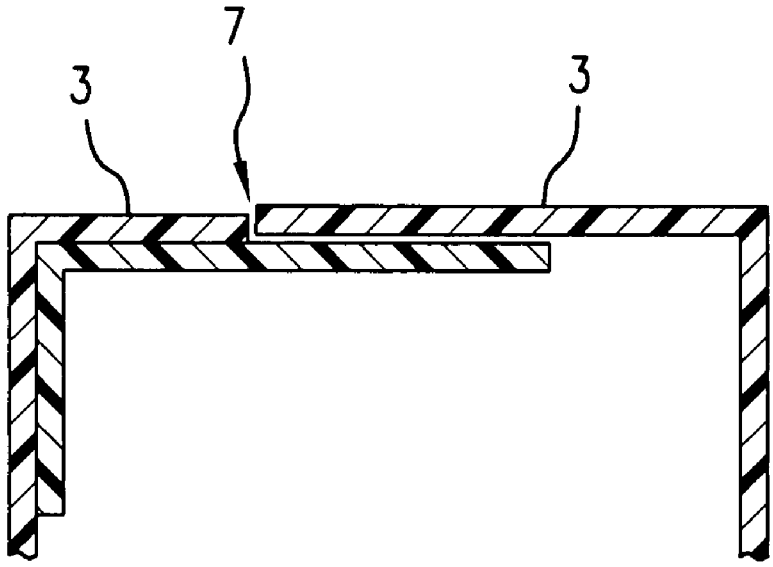
Figure 14D:
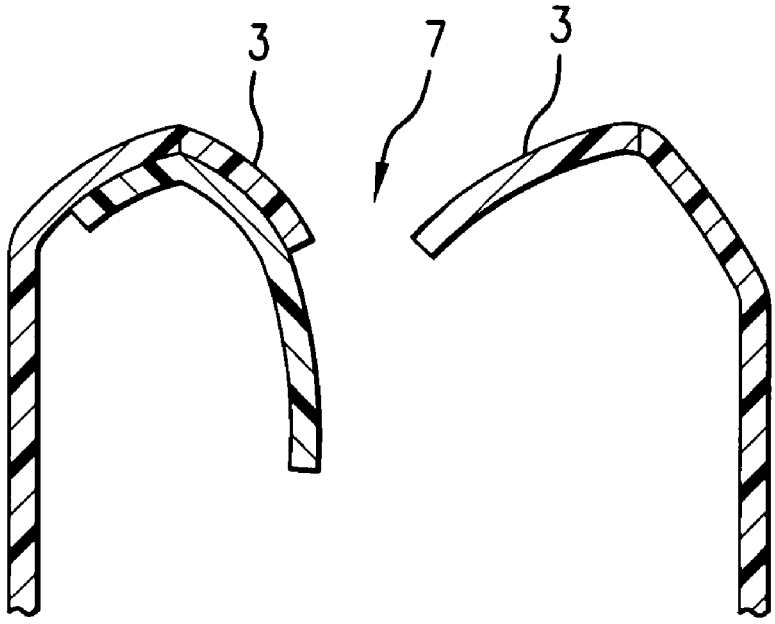

The lowest story (that in contact with the ground) is preferably one that is not penetrated upon a person or object otherwise falling on and into the invention device as shown in FIGS. 13-*a* and 13-*b*. In these embodiments, the lowest story (the "A" labeled units) need not have as large an open vertical space distance as in the stories intended to have persons falling therethrough as set forth above. In FIG. 13-*a*, the "A" story may be a sealed inflated layer that is as little as about 2 feet high or as much as the other stories in the device. In the FIG. 13-*a* embodiment, the "A" story is intended to be a final cushion onto which the person falls and traverses the top of that layer to an exit. Since, the "A" story is not penetrated and rescued persons or rescuers are not traversing the interior of that story, it can be of significantly less height than the other stories. In FIG. 13-*b*, the "A" story need only be sufficiently high so that the rescuees and rescuers can traverse the interior of that story, so that in the FIG. 13-*b* embodiment, the "A" story layer should generally be not less than about 6 feet, preferably not less than about 7 feet, more preferably not less than about 8 feet in height when inflated. In general, the upper end of suitable heights for the FIG. 13-*b* "A" story is substantially less than the other stories as this reduces the overall height of the totally inflated device of the present invention.

A horizontal cross section of the invention device as deployed and inflated reveals that the device (depending on the specific embodiment used) is possibly (a) a single unit, (b) a unitary body having independently operating or cooperatively operating subsections, or (c) may be multiple units linked together in the course of deployment and inflation. Each individual unit and each individual subunit, when deployed has an inflated horizontal surface area which is preferably square or rectangular in shape, preferably square, but may be of any desired shape that is convenient including without limitation, triangular, circular, oval, etc. Each individual unit and each individual subunit is (independently of other units and subunits) of a size such that the horizontal cross section is (or corresponds to) an area of at least about 10 feet by at least about 10 feet, preferably at least about 15 feet by at least about 15 feet, more preferably at least about 20 feet by at least about 20 feet. For embodiments of the invention where the horizontal cross-section of any complete unit or any subunit is not square in shape, the shortest side of any polygonal shape and the shortest axis of any conic sectional shape (circles ovals, ovoids, etc) should meet this minimum limitation. In addition, each individual unit and/or each individual subunit is of a size that its horizontal cross-section is generally not larger than about 50 feet by not more than about 50 feet, preferably not larger than about 40 feet by not more than about 40 feet. Particularly advantageously sized individual units or individually sized subunits are of square horizontal cross-section having dimensions of about 10 feet by about 10 feet, about 12 feet by about 12 feet, about 15 feet by about 15 feet, about 20 feet by about 20 feet, 25 feet by about 25 feet, or about 30 feet by about 30 feet. Other sizes of use in particular situations will also be apparent to those of ordinary skill. For embodiments of the invention where the horizontal cross-section of any complete unit or any subunit is not square in shape, the longest side of any polygonal shape and the longest axis of any conic sectional shape (circles ovals, ovoids, etc) should meet this minimum limitation.

Individual units are preferably outfitted with means for attaching individual units to each other to construct larger devices of the present invention in the field as needed. Such attachment means can include, but are not limited to electronic seaming, heating, gluing, and other types of resilient fusing methods that are compatible with the particular fabric forming the exterior surfaces of such unit that are or may be joined to such comparable surfaces of adjoining units.

The devices of the present invention can be plain without marking on the exterior or can have graphic or textual printed instruction (as shown in FIG. 1) directed to one who is to land on the device as to how to best position oneself and as a target to aim for. Preferably, these markings are of sufficient size that they can be readily seen from large distances so that one who is in the process of falling toward the device has a reasonable amount of time to recognize the instruction and attempt to conform thereto prior to contacting the device.

For ease of discussion, construction details will be set forth with respect to an embodiment that has a horizontal cross section that is square in shape and has four square subsections each of equal size and linked together so that each subsection has 2 external side walls and 2 "internal" side walls (i.e., internal to the assembled 4 subunit system), where each of the "internal" side walls of any one subsection is either abutting and attached to an "internal" side wall of an adjacent subsection or the two abutting subsections share a common side wall. When two "internal" side walls abut each other, the subsections are generally assembled from independent subsections. When two abutting subsections share a common sidewall, they are not separable independent subsections, but permanently linked together. Either construction is within the scope of the present invention. Most preferably, the former construction is used as it allows for greater flexibility in maintaining and regulating inflation air pressure within the invention device. When independent units are linked together (one sidewall of one such unit abuts a sidewall of another such unit), the device may be pre-constructed as a single unit or the individual units may be affixed to one another at the site of use as desired.

Figure 7:
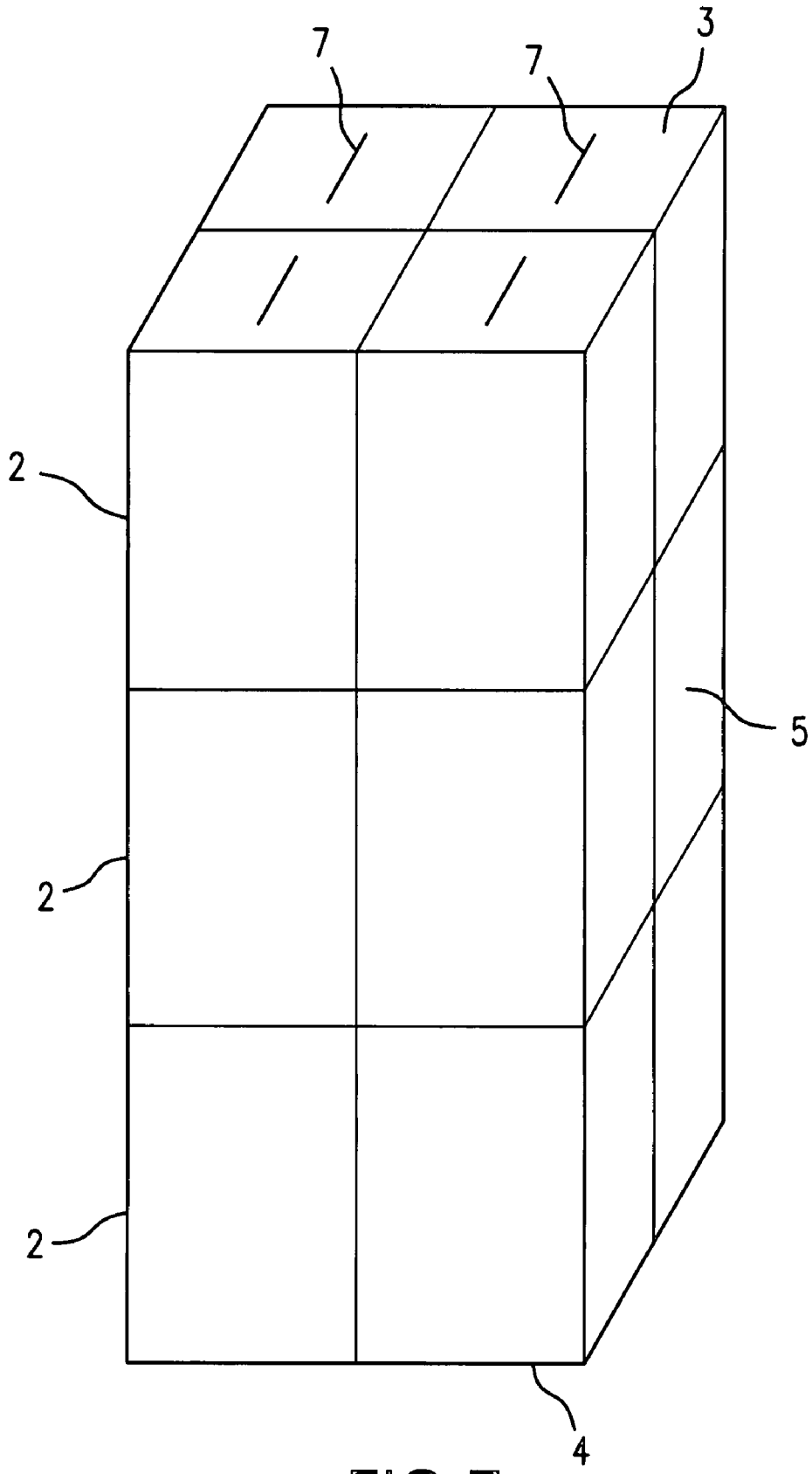
FIG. 7 is a perspective view of an assembly of individual units.
Figure 8:
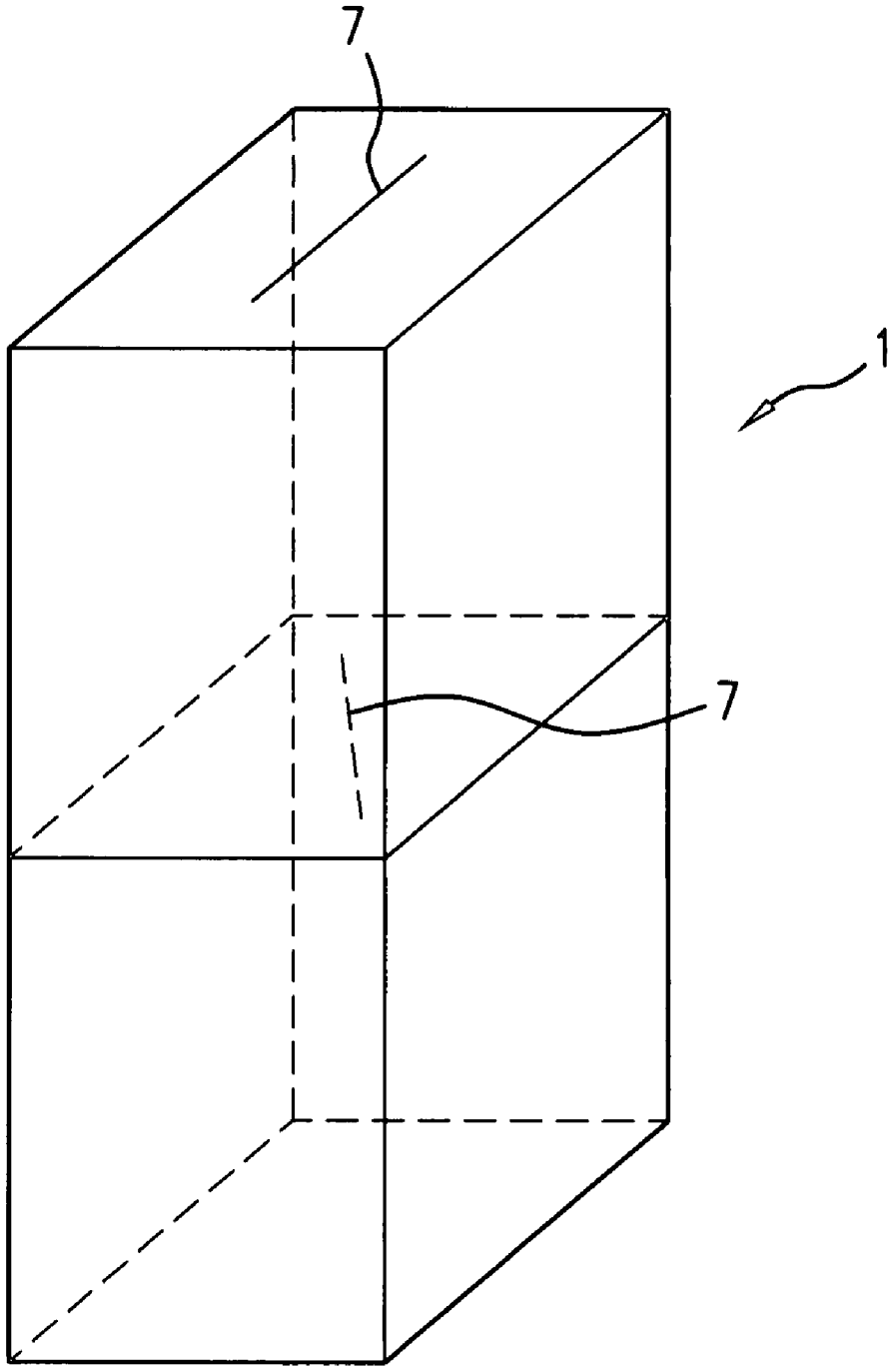
FIG. 8 is a top view showing one embodiment of openings.
Figure 11A:
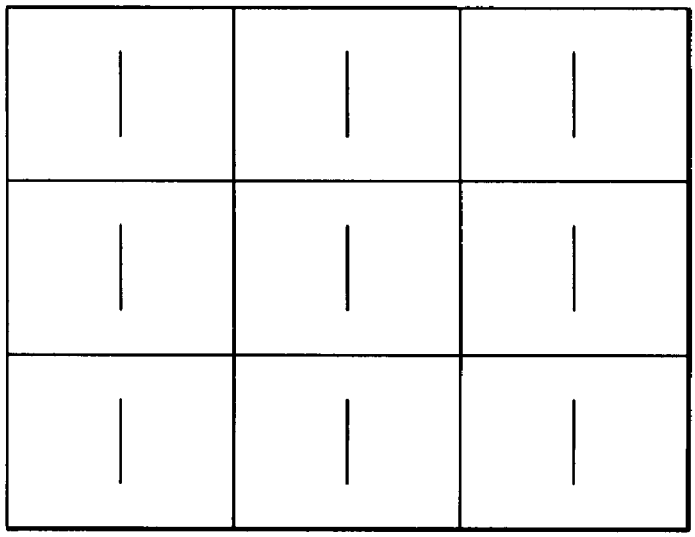
FIGS. 11-*a* through 11-*c* are top views of a 3×3 matrix of units of subsections showing various opening designs.
Figure 11B:
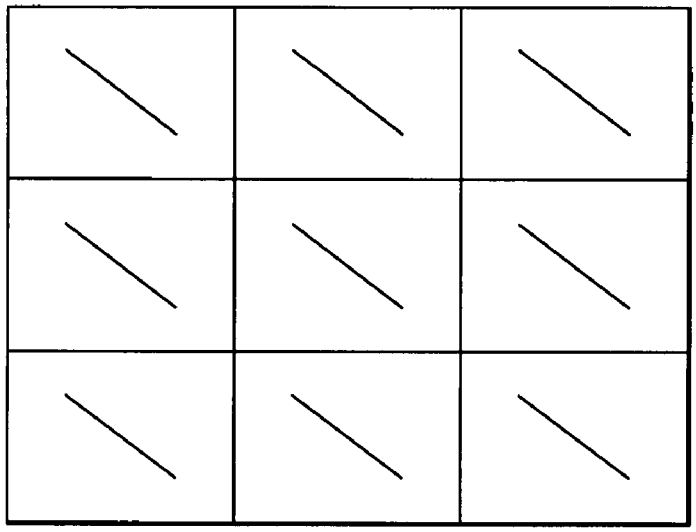
Figure 11C:
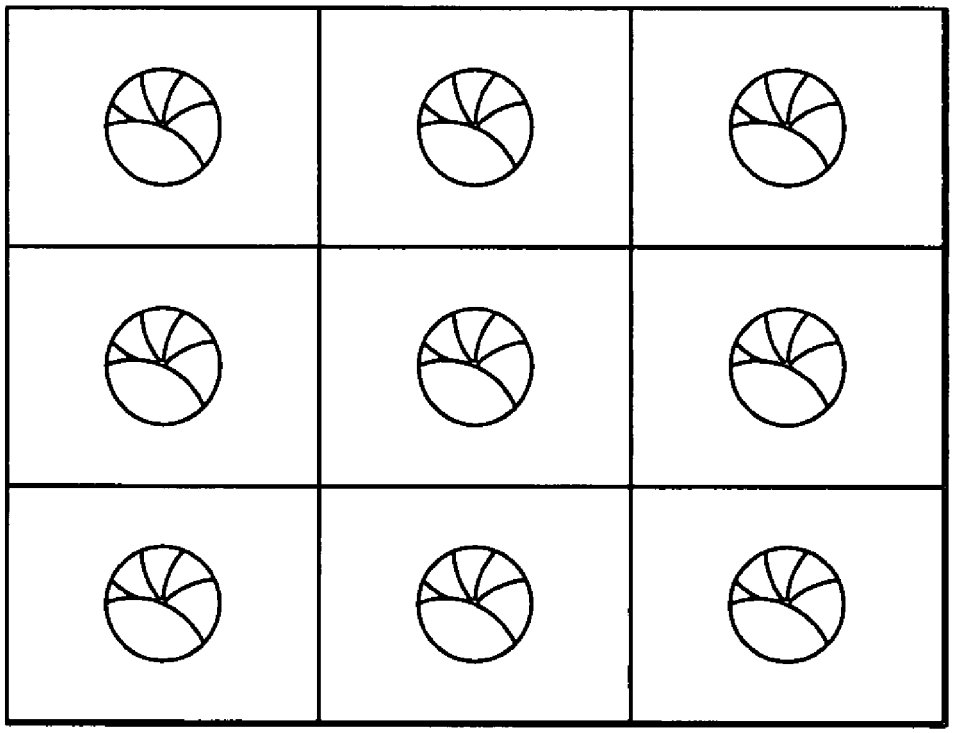
Figure 12A:
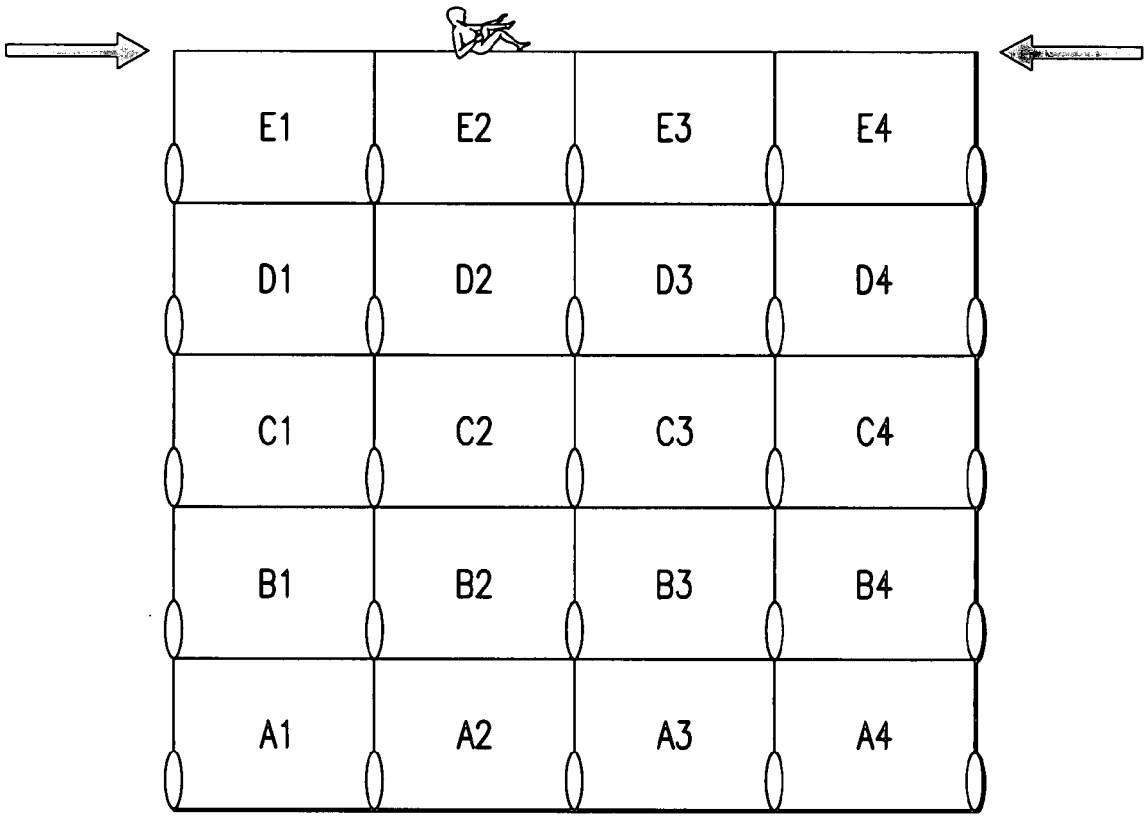
FIGS. 12-*a* through 12-*e* are representative cross-section views showing a person contacting and falling through a device of the present invention.
Figure 12B:
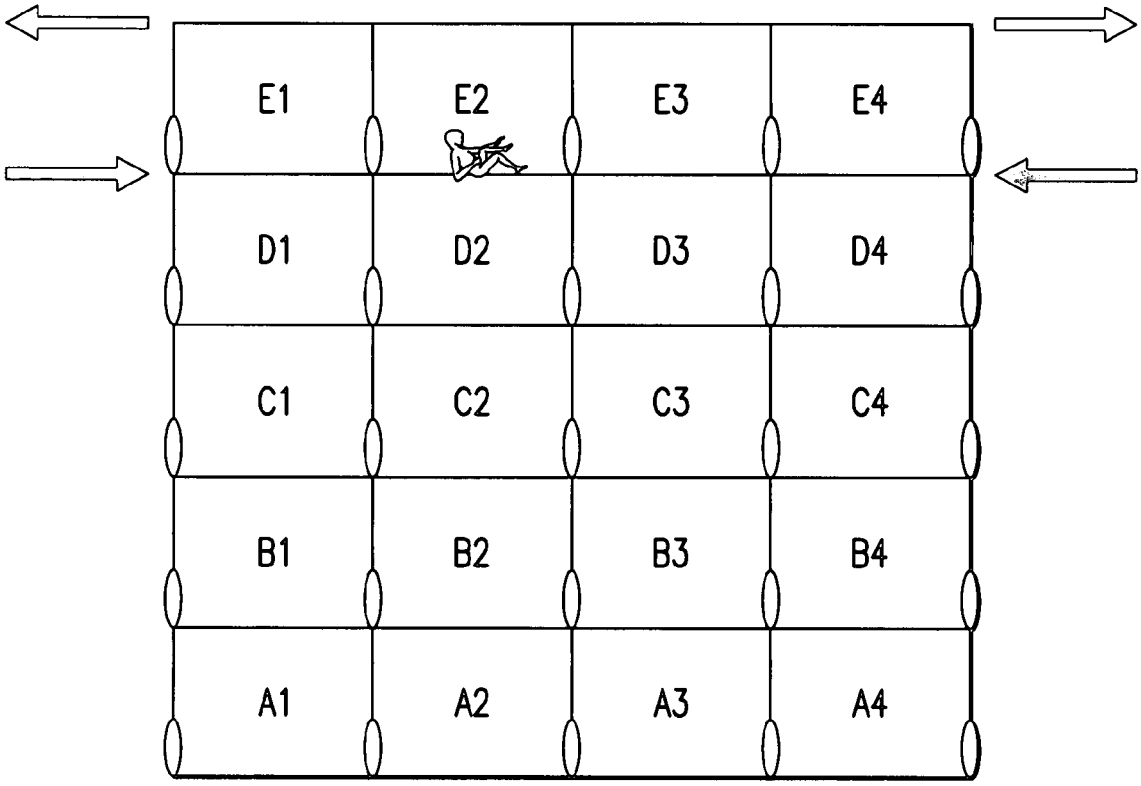
Figure 12C:
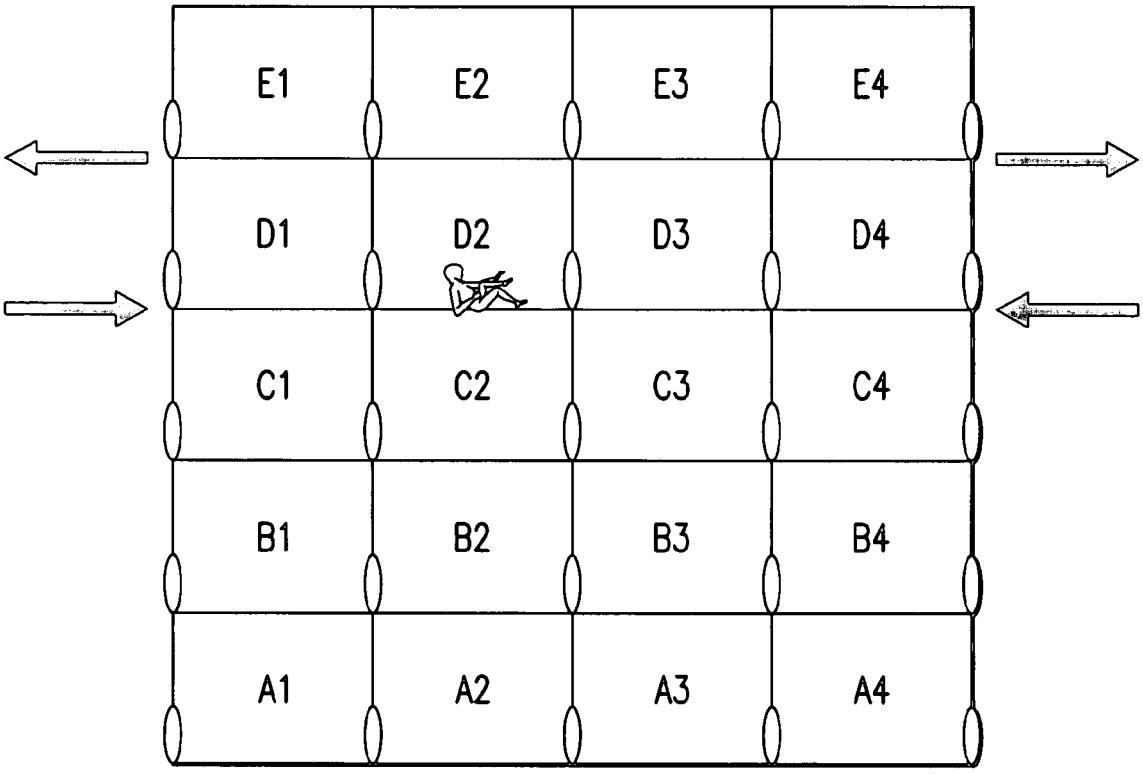
Figure 12D:
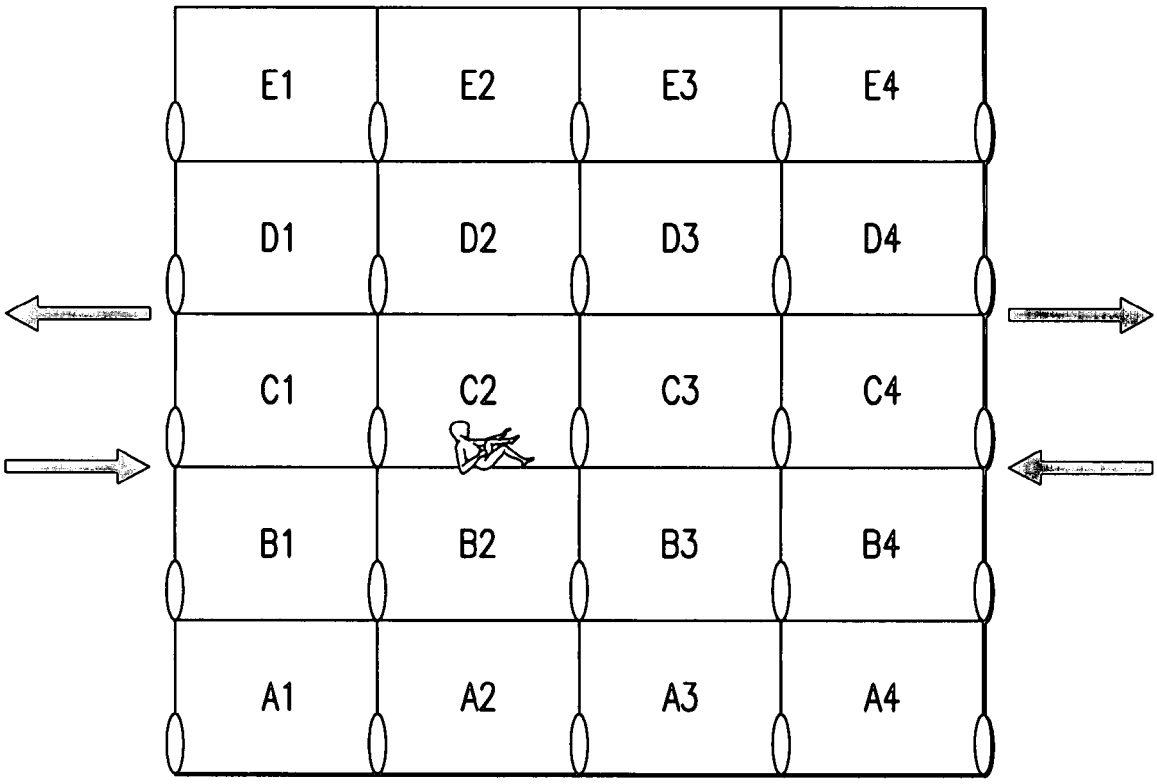
Figure 12E:
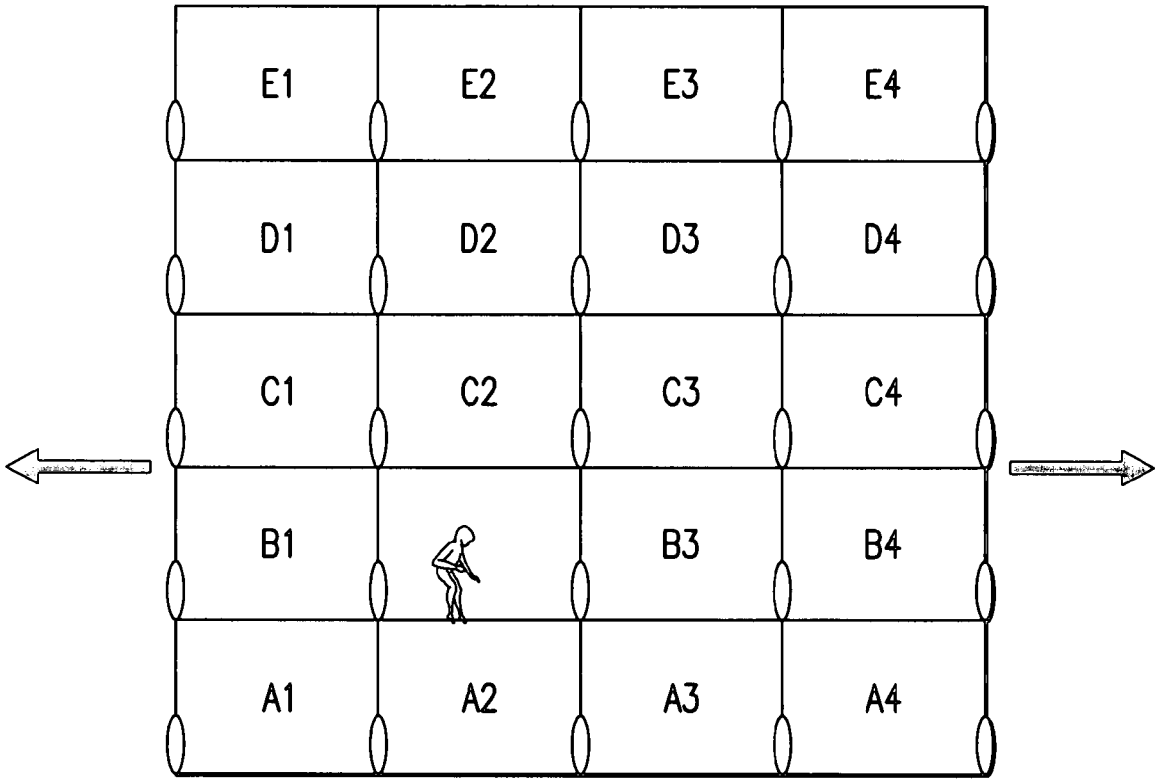

Before discussing an assembly of multiple sections, a single subunit is discussed in greater detail. The single unit without any subsection is constructed so that it has an opening (7) at the top (as deployed) through which an object falling thereon can pass into the interior of the uppermost portion. (See FIGS. 7, 11-*a* through 11-*c*, and 14-*a* through 14-*d*.) The opening is generally located approximately centrally with respect to the subunit horizontal cross-section. The opening may be of any desired shape and cross-section, but is typically in the configuration of one or multiple substantially straight lines radiating from a common centerpoint. Each opening line is generally larger than 12 the largest dimension of the objects typically expected to be falling onto the pad so that the total distance of two approximately diametrically opposed radiating lines from such a central point define an opening that is larger than the largest dimension of persons, animals, or objects generally expected to fall onto the invention device. Thus, in devices intended usually for rescuing persons, this radial distance is generally at least about 4 feet, preferably at least about 5 feet so that persons of under 8 feet in height (essentially the entire human race) can take benefit of the invention. Smaller and larger openings are possible, but are less preferred because of limiting the rescuee population (smaller sizes) or reducing the effectiveness (by too readily permitting falling object to penetrate the next level) of the invention. In a preferred embodiment, the portions of the subsection surface in the region of the opening, overlap one another (see FIGS. 11-*c* and 14-*a* through 14-*d*) so that when inflated, they create some significant resistance to the falling object as it contacts the surface and pushes its way through the opening. Each portion of the surface defined by an adjacent pair of these openings defines the surface of a portion (flap) that may be filled with appropriate gas (if desired) and constructed of appropriate materials (as described later) so that each can be individually or commonly regulated. One preferred arrangement of such openings is patterned on the one way valve operating arrangement of an atrial valve oriented so that weight bearing down at the valve arrangement forces the valve open to permit the weight through, but once the weight passes through the valve, it closes again so as to help maintain the internal gas pressure in the unit interior. (See FIGS. 11-*c* and 14-*a* through 14-*d*.) The openings of one story may be lined up with those of another story, may be given a slightly different orientation, or may be translated in location from those of the story above and below the story in question. The embodiments wherein all of the openings in a vertical series of stories is aligned both in orientation and placement is the least preferred since this allows for the most rapid penetration of the device with the least slowing of the falling person. Having two adjacent stories with their respective openings translated slightly to one side or another relative to each other requires the person falling therethrough to contact a greater portion of the fabric forming the surface of the next story penetrated and thus dissipates some of the energy of the fall and slows the descent. Similarly rotating the direction of the opening also causes the person to contact additional fabric and dissipate energy and slow the descent. Thus, if the uppermost story opening is centrally located and parallel to two edges, a preferred embodiment places the next lower story opening slightly off center. In another preferred embodiment, if the opening of the first surface contacted has a particular orientation, the next surface contacted to be penetrated preferably has that orientation rotated about its centerpoint to an orientation which is not the same as the immediately prior opening. In a most preferred embodiment, both of these are taken advantage of at the same time. The fabric at the site of these openings may further be overlapped (see particularly FIGS. 14-*a* to 14-*d*) with or without self-sealing means (such as self-adherent plastic coatings, Velcro, etc.). The self sealing means adds additional penetration resistance and further helps to preserve air pressure within the device. The fabric at the openings and the flaps that make up the openings may be inflatable, which aids in the closure of the opening so as to create a further penetration resistance as well as aids in preserving air pressure within the device. The air pressurized opening flaps is a particularly preferred embodiment of the invention in that it permits adjusting of the penetration resistance of the opening, whereas the other penetration resistance aspects of the invention are fixed upon construction. It also aids in closure of the opening once it has been penetrated by a first party falling onto the invention device and penetrating that same opening. An alternate embodiment (not shown) has the "valve" arrangement of flaps recessed slightly within the opening so that the falling person first falls into the opening and then contacts the "valve" flaps.

In the uppermost level, the flaps have the least gas pressure therein so that the resistance is least and slowing of the falling person is least effective. This is necessary in that the slowing of a falling living or fragile body needs to be done gradually. As the person or object penetrates the first story, the falling person, then encounters an open space at the interior of the unit, and falls to the bottom of that story, wherein another surface similar to the topmost layer is encountered except that the material of the bottom of the story just traversed is more resistant to the person continuing to fall and/or the gas pressure within the flaps of the that surface are stiffed by a higher gas pressure, and/or the opening is displaced slightly from being directly beneath the prior opening and/or the overlap of the flaps is greater than that in the story above and/or the openings are fused closed at more points than in higher stories or any combination of the above. A convenient manner is to have portions of the openings velcroed closed at intermittent points with a greater number of points being used in lower stories and fewer ones in higher stories. While Velcro is fairly abrasive, the limited size of the Velcro closure should make it a reasonably effective and cheap manner of effectuating (in whole or in part) differences in resistance to object penetration from one story to the next. Furthermore, such Velcro closures effectively aid in self sealing of the opening as once the object falling on the opening passes therethrough. The air pressure gradient will force the opening to close back on itself allowing the Velcro to grip its mating surface so that the closed opening can await the next object to fall upon it and again offer resistance to fall.

In either case, the result is that each subsequent story slows the descent and penetration of the person or object falling therethrough to a greater degree with each story penetrated. Sidewalls may have, but need not have independent gas containing or fillable cells within them so that they may be independently pressurized from the horizontal layers, in whole or in part. In addition, in preferred embodiments, each side wall (preferably independently within each story) has an independent gas pressure maintenance means so that sidewall vertical maintenance can be achieved or modified as needed.

Portions of the internal spaces encountered by the person falling through the device that are not in the region of the opening preferably have independent gas pressurized portions with sufficient resilience that rescuers can traverse the interior of the device in an effort to extricate the falling person or object once it has slowed sufficiently or stopped falling. In a preferred embodiment, there is a second opening similar to those described above, but located at the periphery and having above and below it (but generally, not through such second opening) a descending/ascending device (typically a series of vertical steps) where the opening is considerably smaller (i.e., a radial distance from a central point of not more than about 2 to about 3 feet and generally defining a semicircular area of the floor of that story. This area may be used by rescuers to gain access to interior portions and extricate persons, animals, or objects that have fallen into the device and have stopped their descent therethrough.

Once the fall has been sufficiently broken, instead of continuing in a series of openings from one story to the next, an alternative further deceleration model is that the falling person or animal or object next falls onto a slide that sweeps the person or animal or object in an increasingly horizontal downwards slope. Initially the slope is steep so that the downward speed is only slightly impacted, with the slope changing to slighter and slighter grades (preferably in a substantially gradual and preferably in a substantially smooth manner) so as to gradually slow the descent. Preferably, the slide draws the person, animal, or object to the perimeter of the subunit or device (as the case may be) and converts most of the energy of the descent into circumferential force that can be dissipated without harming the falling body.

The various units of the device may be constructed throughout of similar fabrics or may have different fabrics in different stories so that the difference in fabric can contribute to the differences in resistance to falling desired in the device. Typically, the various units may be constructed from fabrics such as, but not limited to, Nylons that are suitable for use as parachutes, hot-air balloons, Air-ship Blimps, and marine sails (such as Soar-Coat and Exacta-Chute available from PerfTex of Greensboro, N.C., parachute materials available from Precision Fabrics Group; parasail fabric available from Gelvenor http://www.pia.com/gelvenor/parafab.htm; Pertex Blue Quantum available from Perseverance Mills, Albion Mills, Padiham, Lancashire, England.); polyester, Gotrtex, etc. Each of these may be used as is or coated with various materials to reduce the porosity thereof. In general, as one goes from the top of the invention device to the bottom, porosity of the materials may be decreased as a means of regulating (in whole or in part) the gas permeability between stories and between units so that the resistance gradient to the falling person or object is better maintained. Means of obtaining varied porosity fabrics are well known to those of ordinary skill in the art and are generally available.

Gas pressure is generally provided by one or more of the following, but other methods for maintaining large volumes of substantial air pressure would be just as suitable; for example, simple motors with fans, fan and tunnels or channels, jet turbines, chemical gas canisters, compressed air canisters, etc. Any or all of these and other similar gas handling means may be used as the source of positive gas pressure. Multiple such gas pressure generating units may be used, for example located at various perimeter sites of exterior portions of the completed unit, and potentially auxiliary such positive gas pressure maintenance devices may be located at different stories taking as a source of gas either external ambient air or further moving air located internal to the structure to more interior portions.

Gas inlets would blow various levels of gas pressure in to the various stories, units, subunits, and portions of individual units or subunits as needed. Channels for gas distribution are distributed throughout the invention device, but are preferably confined to one or both of (a) the periphery of the internal open space and/or (b) within the sidewalls (separating units and subunits from each other) and between the floor of one story and the ceiling of an adjacent story. In a particularly preferred embodiment, the channels are arranged in spider-web-like patters or in octopus tentacle like patterns. (See FIG.

9 for an exemplary representation of such arrangements.) The main purpose of these patterns is to be able to not only control air pressure within the invention, but also to be able to quickly inflate/re-inflate the invention and to permit the invention to withstand tears and rips or other compromises of the invention device integrity without causing a fatal collapse of the unit. In conjunction with the channels, the invention typically employs various pressure monitoring devices and computer coordination of the results of those outputs to direct and redirect auxiliary air pressure where needed so as to maintain the overall integrity of the invention device as well as to further aid in the presentation of a penetration resistance gradient to slow the descent of a person, animal, or object through the various stories of the invention.

Figure 9:
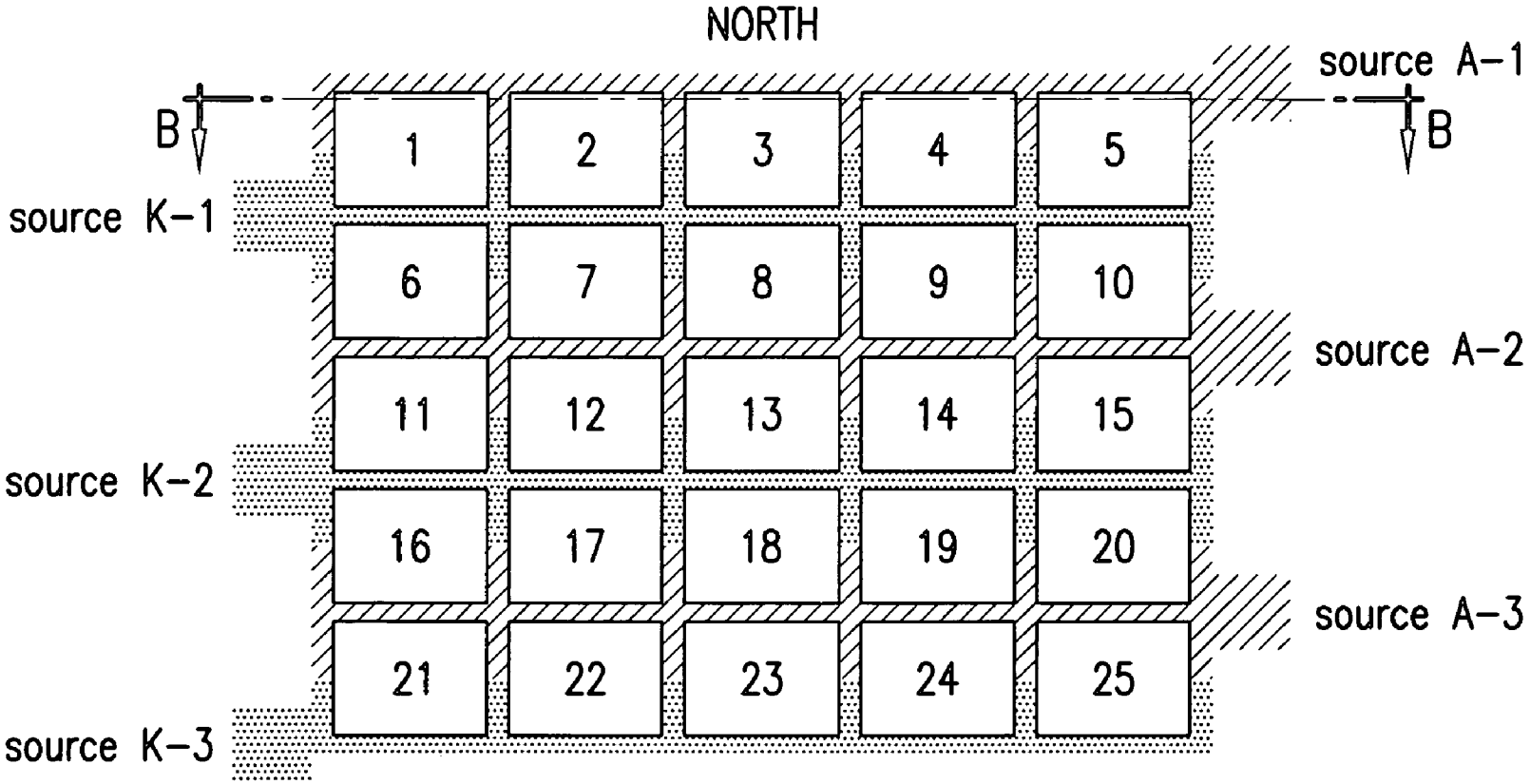
FIG. 9 is a representative top view of a 5×5 matrix of units or subunits in a single story showing gas pressure sources and air channels.
Figure 10:
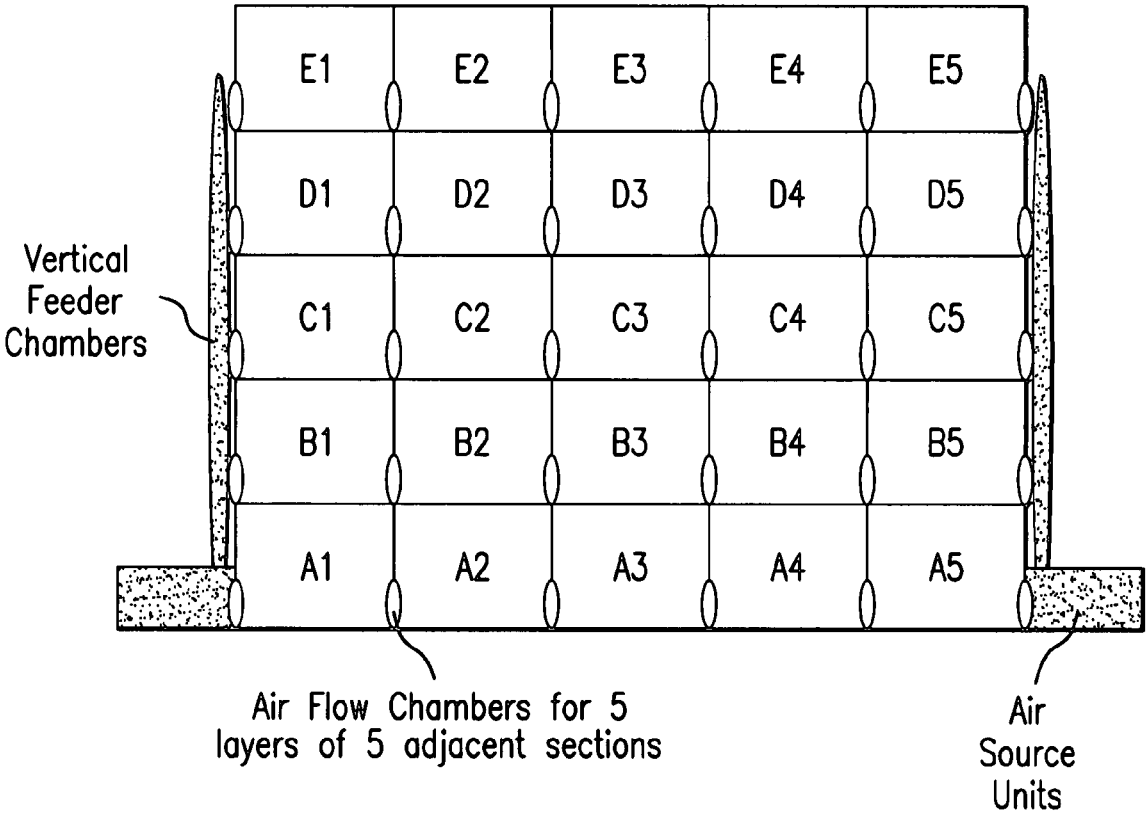
FIG. 10 is a vertical cross-section along line B-B of the embodiment in FIG. 9.

FIG. 9 shows top view of a cross-section of a 5×5 array of units of the invention. For ease of discussion, the top of the page is designated "north", with the individual units being labeled 1 through 25. Air pressure sources A-1 to A-3 are located on the east side and air pressure sources K-1 through K-3 are located on the west side. (These are only exemplary placements of the air pressure sources, which can be placed at various other points as desired rather than those shown in FIG. 9.) The use of such auxiliary air pressure maintenance and air flow movement devices is extremely advantageous as the size of the completed device of the invention increases (because either it is of a large initial construction or because multiple units have been assembled together. The use of multiple air pressure maintenance devices is also advantageous over a single such device as multiple such units allow for a more rapid recovery time and air pressure maintenance after a person or object has fallen onto and penetrated into the invention device. With reference to FIG. 9, air pressure source A-1 services units 1-5 from the north side, air pressure source A-2 services units 6-10 from the south side and units 11-15 from the north side, and air pressure source A-3 services units 16-20 from the south side and units 21-25 from the north side. In a corresponding manner, air pressure source K-1 services units 1-5 from the south side and units 6-10 from the north side, air pressure source K-2 services units 11-15 from the south side and units 16-20 from the north side, and air pressure source K-3 services units 21-25 from the south side. FIG. 10 shows a vertical cross-section of FIG. 9 along line B-B. In FIG. 10, five stories of units 1-5 are shown and labeled A through E respectively. In the FIG. 10 embodiment, all air pressure sources are shown on the ground level. However, if desired, additional supplemental air pressure sources may be utilized at portions that are not at ground level. In any event, the air pressure source A-1 feeds air pressure into the vertical feeder chamber and air flow chambers to which it is connected. The vertical feeder chambers then feed the air flow chambers at higher stories. In general, the air flow chambers of one story are separate from those of another story other than through the vertical feeder chambers. However, if desired and preferred, secondary connectors between stories may be constructed into the device, most preferably with air pressure and air flow monitoring and controlling means. Thus, should any portion of the device have its primary air pressure feed interrupted or lost, appropriate secondary air pressure control means may be enlisted to re-establish appropriate air pressure for proper functioning of the invention device. It should be noted that the air handling channels (airflow chambers in FIG. 10) occupy preferably only a relatively small potion of the distance between two stories. While larger air flow chambers are suitable, the smaller the air flow chamber, the more contact there is between two abutting units so that vertical integrity is better maintained. However, this is balanced against the need to maintain suitable air pressure over a relatively large area and the need to re-establish air pressure quickly. Smaller air flow chamber diameter also means that it is less likely for a tear in the device to disrupt an air flow chamber.

Advantageously, especially in larger units and devices, air flow pressure may be aided by use of closed circuit wind tunnel designs (in whole or in part) where exiting air can be recycled to intake vents to increase air usage efficiency. When such closed circuit designs are used alone, the air pressure merely gives the structure firmness and the resistance to a falling body is due primarily to the fabric surfaces, the stiffness generated by the closed circuit channels to which they are attached, and any opening closure sealing means employed. Where such closed circuit designs are not actually "closed circuit systems", the same principles are at play, but because the systems are not closed, air and pressure are exiting therefrom and the resistances generated thereby are not as great as with closed systems. In addition, the fact that air is then lost to the environment means that the intake air pressure must be constantly applied at a greater rate than in those devices taking advantage of closed system designs. In addition to these air handling aspects, the interior spaces of the invention units can also be pressurized so that a falling object encounters a "wind resistance against the object in the direction opposite that of the falling direction. Such additional wind resistance further aids in the slowing of the downward velocity of the falling object.

The above air handling system may be constructed to simply operate without further controls or monitoring, but advantageously, the air pressure and air flow is monitored by various air flow and pressure sensing devices well known in the art. Such monitoring means are generally scattered about the device so that various sections can be separately monitored and additional air pressure and volume directed to areas needing such additional air pressure. Thus, the air handling system described above may further include means for adjusting air pressure and air flow therein in a targeted manner. Thus, the air flow channels may further contain one way valves to allow greater air pressure to be delivered to particular regions. Such monitoring outputs, valve control, and intake pressure generation may be, and most preferably is, under control of an electronic control unit, most preferably a computer, so that rapid and efficient control of the many aspects and devices within the device of the invention can be readily handled. Typical one way valves for use in the invention include those resembling an aortic tricuspid valve, which operate automatically to resist backward pressure, but many other such valve designs are known in the art and would work as well. While automatically operating one-way valves are most desirable, other valves requiring electronic or other form of control thereof between open and closed positions are also usable, they require more complex features and parts and are thus less desired.

While the materials for the construction of the present invention can be selected from a wide range of materials without special features, preferably the materials used in invention units should have at least one of the following features: UV resistance, tear resistance, abrasion resistance, pollution resistance, oil resistance, resistance to fire-fighting chemicals, heat resistance, fire resistance, and smoke resistance, as these qualities will help insure that the invention can be most suitably be used confidently without excessive concern for product failure. Materials which have a number of these characteristics are more highly preferred than those with fewer of these characteristics. Fabric coatings and metal part coatings known in the art to deliver these properties are known and should be used when possible, but devices which do not utilize these coatings or have these properties are still within the scope of the present invention.

FIGS. 12-*a* through 12-*e* show a representative 5 story embodiment of the invention with a person landing on and penetrating the device. Initially, on impact with the device at the top of unit E2, the upper surface "gives" toward the point of impact (as indicated by the bold arrows in FIG. 12-*a*). Once the person penetrates the E story, the person falls through the E story and impacts the surface separating E2 from D2, while the prior surface that "gave" now recoils toward its pre-impact displacement and the new surface contacted "gives" under the impact. (See FIG. 12-*b*.) The same scenario repeats as the person penetrates the surface separating D-2 and C-2 and then proceeds to fall through C-2 (see FIGS. 12-*c* and 12-*d*). On falling through the surface separating C2 and B2, that surface recoils towards its original tension and orientation (see FIG. 12-*e*). Finally, the falling person falls onto the bottom surface of B2, a surface which has now stopped the descent completely, and the person landing thereon exits the device, exemplified by two potential means shown in FIGS. 13-*a* and 13-*b*. FIG. 13-*a* provides a ladder or some other external further descent means, while FIG. 13-*b* indicates an internal air lock exit for the person rescued to utilize to further descend within the device structure to the exits. In order to maintain air pressure in the most efficient manner, all exit points should and preferably do utilize multiple air locks. A simple air lock is just a double closure separated by a short distance, sufficient to allow the user to enter into the lock, close the lock and open the other end of the lock allowing egress to the outside. In preferred embodiments, the air locks, in the process of being operated, will depressurize the air lock interior (when operated from the internal side of the air lock) or pressurize the air lock interior (when operated from the ambient side of the air lock) to thus avoid persons being ejected from the air lock or prevented from leaving the air lock. Such air locks and mechanisms are well known in the art.

While the device of the invention has been described with respect to land based deployment and usage, corresponding floating devices are also considered within the scope of the present invention for use on water rescue operations, whether from ships or similarly from buildings in places such as Venice, Italy. In floating embodiments, the only additional aspect that the device may need, and preferably has, is a mooring means to secure the device in place so that it does not separate from the ship or building from which rescue is being attempted.

I claim:

1. A balloon landing pad device comprising a) a first surface layer defining a top of said device having at least one transverse opening therein;

b) a second layer defining a bottom of said device;

c) side walls connecting said top to said bottom;

d) an interior defined by said first surface layer, said second layer, and said side walls; said interior comprising regions of increasing density or penetration resistance gradient or combination thereof when traversing from said top toward said bottom;

said interior further comprising at least one intermediary third layer separating said interior into at least two stories stacked one above the other, each adjacent pair of said stacked stories being referred to as an upper or lower story respectively of said pair of stories, such that said intermediary third layer defines a floor of said upper story and a ceiling of said lower story;

said top also defining a ceiling of the uppermost of said at least two stories and said bottom also defining a floor of the lowermost of said at least two stories; each of said at least two stories having a minimum distance between said ceiling and said floor thereof of at least about 5 feet;

each of said first surface layer and each intermediary third layer having at least one opening therein through which a person, upon landing on said device, falls through said first surface completely into said interior, continues to fall through at least one of said upper stories and land upon said intermediary third layer forming said floor of said upper at least one upper story, continues falling through said opening in said intermediary third layer completely into at least one of said lower stories, and completely thorough at least one of said lower stories;

said bottom being in contacting a hard support or liquid surface onto which said device is placed, said bottom having an upper surface distal to said hard surface or liquid surface on which it is placed defining a final floor of the interior and designed to cushion said falling person from contacting said hard support or liquid surface;

said interior comprising regions of increasing density or penetration resistance gradient or combination thereof as said falling member penetrates from said top toward said bottom;

said device being of a size to cushion said at least one falling person so as to prevent said at least one falling person from striking said hard support or liquid surface after having slowed the rate of descent of said at least one falling person as said at least one falling person traverses from said first surface, through said opening in said first surface, through at least two of said at least two stories and at least one of said at least one intermediary third layer separating at least two of said at least two stories from each other, toward said bottom.

2. The device of claim 1 wherein each of said top, bottom, and intermediary third layers being independently chosen from the group of materials selected from the group consisting of plastics, nylon, cloth, canvas, paper, rubber, cotton, polyvinyl materials, mixtures thereof, blends thereof, and composites thereof.

3. The device of claim 1 wherein said interior further comprises one or more interior layers; each of said top, bottom, and intermediary third layers being independently made of one or more materials such that independently said top, bottom, and interior layers have at least one property selected from the group consisting of being lightweight, water repellant, waterproof, wind shear resistant, windproof, fire resistant, fireproof, heat resistant, UV resistant, cold resistant, and freeze resistant.

4. The device of claim 3 wherein each of said top, bottom, and intermediary third layers being independently chosen from the group of materials selected from the group consisting of plastics, nylon, cloth, canvas, paper, rubber, cotton, polyvinyl materials, mixtures thereof, blends thereof, and composites thereof.

5. The device of claim 1 wherein each of said top, bottom, and interior stories has its own cushioning properties.

6. The device of claim 5 wherein each of said top, each of said interior stories, and said bottom are independently separated from each adjacent story by a distance of not less than about 6 feet.

7. The device of claim 6 wherein each of said top, each of said interior stories, and said bottom are independently separated from each adjacent story by a distance of not less than about 10 feet.

8. The device of claim 7 wherein each of said top, each of said interior stories, and said bottom are independently separated from each adjacent story by a distance of not less than about 20 feet.

9. The device of claim 6 wherein each of said top, each of said interior stories, and said bottom are independently separated from each adjacent story by a distance of not more than about 30 feet.

10. The device of claim 9 wherein each of said top, each of said interior stories, and said bottom are independently separated from each adjacent story by a distance of not more than about 25 feet.

11. The device of claim 10 wherein each of said top, each of said interior stories, and said bottom are independently separated from each adjacent story by a distance of not more than about 20 feet.

12. The device of claim 6 wherein each of said top, each of said interior stories, and said bottom are independently separated from each adjacent story by a distance of about 10 feet to about 20 feet.

13. The device of claim 1 wherein said device further comprises independently within each of said top, bottom, and interior, one or more gaseous material fillable chambers.

14. The device of claim 13 further comprising gas inlets and outlets, which gas inlets and outlets connects at least one of said chambers to (a) another of said chambers, (b) to the exterior environment, or (c) to a gas inlet source.

15. The device of claim 14 wherein said gas inlets and outlets are independently selected from the group consisting of flap valves, gas valves, compressed gas cartridges, mechanized gas movement sources and combinations thereof.

16. The device of claim 15 wherein said mechanized gas movement sources are members selected from at least one of the group consisting of motors, fans, jet fans, and turbo fans.

17. The device of claim 14 further comprising at least one member selected from (a) one or more gas pressure gauges and (b) one or more gas flow gauges, which gauges are associated with at least one of said chambers.

18. The device of claim 1 wherein at least one of said density gradient and said penetration resistance gradient is provided in whole or in part via gas pressure regulation within said device and said device contains at least one means for regulating said gas pressure therein.

19. The device of claim 18 wherein each of said means for regulating gas pressure in said device independently comprises at least one member selected from the group consisting of gas pressure monitoring means, gas intake flow regulating means, gas outflow regulating means, and gas compartment redistribution means.

20. The device of claim 19 wherein one or more of said means for regulating gas pressure in said device independently includes a member selected from the group consisting of one or more compressed gas canisters, one or more motors, and combinations thereof, associated with one or more jets or nozzles, each of said jets and nozzles, when associated with said jets and nozzles being adjustable in response to either a pre-programmed protocol or to an operator instruction.

21. The device of claim 1 wherein said device has a total horizontal cross section and said horizontal cross section is subdivided into at least two horizontal subsections wherein each portion of said device corresponding to any one horizontal subsection is operable independently of one or more other of said subsections.

22. The device of claim 21 wherein in the course of deployment of said device one or more subsections is capable of being cut away or retained in a deflated state, independent of adjacent subsections so as to permit deployment of said device in odd shaped areas where full deployment of said device is not suitable, and said subsections adjacent to any of said cut away subsections continue to operate in intended manners.

23. The device of claim 21 wherein each of said horizontal subsections is independently a square or rectangular shape and an area of at least about 10 feet by at least about 10 feet.

24. The device of claim 23 wherein each of said horizontal subsections is independently an area of at least about 15 feet by at least about 15 feet.

25. The device of claim 24 wherein each of said horizontal subsections is independently an area of at least about 20 feet by at least about 20 feet.

26. The device of claim 1 wherein said interior of said device further has at least one exit opening through which said falling member can leave or be removed from said interior of said device.

27. The device of claim 1 wherein said device upon full inflation has a total vertical height of at least about 40 feet over a substantial portion of its horizontal surface.

28. The device of claim 27 wherein said device upon full inflation has a total vertical height of at least about 60 feet over a substantial portion of its horizontal surface.

29. The device of claim 28 wherein said device upon full inflation has a total vertical height of at least about 80 feet over a substantial portion of its horizontal surface.

30. The device of claim 29 wherein said device upon full inflation has a total vertical height of at least about 90 feet over a substantial portion of its horizontal surface.

31. The device of claim 30 wherein said device upon full inflation has a total vertical height of at least about 100 feet over a substantial portion of its horizontal surface.

32. The device of claim 1 further comprising an abrasion resistant coating on external surfaces of said bottom and optionally on exterior surfaces of said side walls for minimizing wear and tear of said surfaces that may be in contact with abrasive environmental surfaces in the course of deployment and use of said device.

33. The device of claim 1 further comprising instructions to a person to be cushioned by said device in the course of said person falling onto said device, which instructions are selected from the group consisting of graphic, textual, and combinations thereof.

34. The device of claim 1 further having means for attachment to one or more additional devices of claim 1 for assembly into larger devices, said larger devices being also devices of claim 1.

35. The device of claim 1 adapted for use over water further comprising mooring means.

* * * * *